US007458475B2

(12) United States Patent
Ho

(10) Patent No.: US 7,458,475 B2
(45) Date of Patent: Dec. 2, 2008

(54) MODULAR TREE-LIKE STRUCTURE FOR HOLDING POTTED PLANTS

(75) Inventor: Chor Joseph Ho, Thornhill (CA)

(73) Assignee: Founder Plastics, Inc., Toronto, Ontario (CA)

( * ) Notice: Subject to any disclaimer, the term of this patent is extended or adjusted under 35 U.S.C. 154(b) by 87 days.

(21) Appl. No.: 10/923,051

(22) Filed: Aug. 23, 2004

(65) Prior Publication Data

US 2005/0082244 A1 Apr. 21, 2005

(30) Foreign Application Priority Data

Oct. 15, 2003 (CA) ..... 2444459

(51) Int. Cl.
*A01G 9/02* (2006.01)

(52) U.S. Cl. ..... 211/85.23; 211/182; 211/196; 211/205; 403/292

(58) Field of Classification Search ..... 403/292, 403/294, 300, 305; 211/205, 196, 85.23, 211/182; 248/159, 370
See application file for complete search history.

(56) References Cited

U.S. PATENT DOCUMENTS

| | | | | | |
|---|---|---|---|---|---|
| 214,061 | A * | 4/1879 | Stearns | 47/67 |
| 2,716,533 | A * | 8/1955 | Freeman | 211/107 |
| 2,794,554 | A * | 6/1957 | Donner | 211/85.23 |
| 3,283,913 | A * | 11/1966 | Van Horn, Jr. | 211/78 |
| 4,117,629 | A * | 10/1978 | Ekdahl | 47/67 |
| D300,699 | S * | 4/1989 | Penrod | D6/405 |
| 4,865,283 | A * | 9/1989 | Parker | 248/159 |
| 4,921,190 | A * | 5/1990 | Russo et al. | 248/159 |
| 5,015,510 | A * | 5/1991 | Smith | 428/18 |
| 5,037,049 | A | 8/1991 | Funk | |
| 5,178,286 | A | 1/1993 | Allison, III | |
| 5,454,661 | A * | 10/1995 | Litvin et al. | 403/298 |
| 5,746,334 | A * | 5/1998 | Brandenberg | 211/205 |
| D403,533 | S | 1/1999 | Paul | |
| 5,904,420 | A * | 5/1999 | Dedoes | 366/198 |
| 6,123,035 | A * | 9/2000 | Pfister | 108/180 |
| 6,308,838 | B1 * | 10/2001 | Endean | 211/37 |
| 6,318,572 | B1 * | 11/2001 | Lai | 211/196 |
| 7,077,277 | B2 * | 7/2006 | Wang | 211/206 |

* cited by examiner

*Primary Examiner*—James Kramer
*Assistant Examiner*—Jared W. Newton
(74) *Attorney, Agent, or Firm*—Gowling, LaFleur & Henderson, LLP

(57) ABSTRACT

A modular, tree-like structure for holding or hanging potted plants is suitable as an indoor flower/herbs stand. A base on casters supports a height adjustable central stem. The central stem is assembled using a coupling device having means rotatably connecting a plurality of branch arms with brackets, or flower basket hooks, for supporting a plurality of potted plants in a horizontally tiered arrangement and un-obstructing tree configuration. The combination of various length/size brackets in a multi-tier arrangement which can rotate independent from the central stem, allows for an increased number of potted plants to be adequately displayed on a given floor surface.

25 Claims, 4 Drawing Sheets

MODULAR TREE-LIKE STRUCTURE FOR HOLDING POTTED PLANTS

FIELD OF INVENTION

This invention relates in general to structures for displaying articles and in particular to a modular, adjustable, tree-like structure for holding potted plants.

RELATED ART

Various arrangements are used for supporting potted plants and providing an aesthetic display, while ensuring adequate sunlight and watering conditions. A variety of plant containers, for example pots, baskets, hanging pots, or hanging baskets are used according to the plant characteristics. Many potted plants are moved indoor during the cold season and outdoor during the hot season; there is a permanent concern with their location especially when moved inside.

Indoor space is at a premium since the space with direct light is in most cases limited. Moreover, individual plants have different demands in terms of light exposure, watering, frequency of fertilizing, etc. Furthermore, when displaying potted plants in a vertical arrangement, they must be arranged such that no plant blocks the natural light to the other plants.

U.S. Pat. No. 5,178,286 to Allison III, discloses a multi-purpose display rack having a central shaft and arms, which are slidable on the shaft, extending in a staggered fashion. Each arm has a disk-shaped base for supporting articles at a certain distance from the shaft. The shaft may be broken down into pieces, and the arms can be disconnected for storage and transport.

U.S. Pat. No. 5,037,049 discloses a foldable tree-like structure having a plurality of tiers of fixed limb-like elements with hooks for hanging plants. Similarly, U.S. Design Pat. No. 403,533 illustrates a mobile display stand having fixed brackets for holding potted plants.

However, prior art plant stands have as a major disadvantage the fact that the structure is fixed and the arm position/length may not fit optimally in the available space. As a result, there is not easy to accommodate such structures indoor, while exposed to the natural light. Furthermore, once the arms are fixedly mounted on the shaft, at least some of the container holders cannot be easily reached and/or replaced.

It is therefore a need for a simple, easy to assemble structure suitable for indoor use for holding potted plants.

SUMMARY OF THE INVENTION

The present invention seeks to overcome the disadvantages of the prior art associated with indoor support structures for potted plants. The present invention discloses a structure that occupies minimal floor surface and supports a large number of potted plants in an un-obstructing tree configuration.

According to one aspect of the invention a display tree-like structure of the type having a stem made of a plurality of end-to-end connected stem elements and a plurality of branches for holding objects, using a multi-purpose coupling device for connecting two consecutive stem elements, is provided. The multi-purpose coupling device comprises a stem connector having a lower plug and an upper plug joined by a stopping ring extending at the exterior of the stem connector at the junction between said plugs; and a first branch support with an outer wall, a cylindrical bore defined by an inner wall, and a friction ring integrally formed on the inner wall for supporting the first branch support on the stopping ring while allowing rotation of the first branch support about the stem connector, wherein the outer wall is provided with a plurality of slots for receiving branch connectors supporting the plurality of branches. Further on, a second branch support may be mounted on top of and in symmetry with the first branch support relative to the large base to increase robustness.

According to another object of the invention a kit for assembling a display tree-like structure is provided. The kit comprises N stem elements; N stem connectors, each having a first and a second back-to-back joined plugs for connecting two stem elements, and a median stopping ring extending to the exterior of the stem connector at the junction between the plugs; at least N branch supports, each branch support with an outer and an inner wall, and a friction ring integrally formed on the internal wall for supporting the stem connector on the stopping ring, while allowing rotation of the branch support about said stem connector, wherein said outer wall is provided with M slots; N×M branch connectors, each for insertion in one of the slots for supporting a branch; and a base provided with a central bore for supporting the tree-like structure.

In the following the terms "potted plants", "containers", "baskets", and "pots" are used interchangeably to define a container (pot, basket, etc) with a plant (flower, herbs, etc).

The multi-purpose tree-like structure (hereinafter called "tree") of the invention occupies a small floor area and is suitable as an indoor flower/herbs stand. It is also to be noted that the invention may be used to display art, or other objects of interest, but the description will refer to the objects as plants.

The plants may be arranged in tiers and positioned in non-obstructing tree configuration, as the height of the standing pole, or central stem is adjustable and the arms with the branch coupling device are rotatably mounted on the central stem. The tree of the invention allows for an increased number of potted plants to be displayed on a given floor surface, enables the user to arrange the plants in a desired position with respect to the source of light and the other layers of plants, and also enables the user to change the position of the plants for optimising the plants development, by alternatively placing the plants in the best light, or/and to change the overall display for aesthetic reasons. To add to these advantages, the tree according to the invention is light, easy to assemble, ship and store, resulting in important space and cost savings.

The "Summary of the Invention" does not necessarily disclose all the inventive features. The inventions may reside in a sub-combination of the disclosed features.

BRIEF DESCRIPTION OF THE DRAWINGS

The foregoing and other objects, features and advantages of the invention will be apparent from the following more particular description of the preferred embodiments, as illustrated in the appended drawings, where.

Similar references are used in different figures to denote similar components.

DESCRIPTION OF THE PREFERRED EMBODIMENTS

The following description is of a preferred embodiment by way of example only and without limitation to combination of features necessary for carrying the invention into effect.

Figure 1:
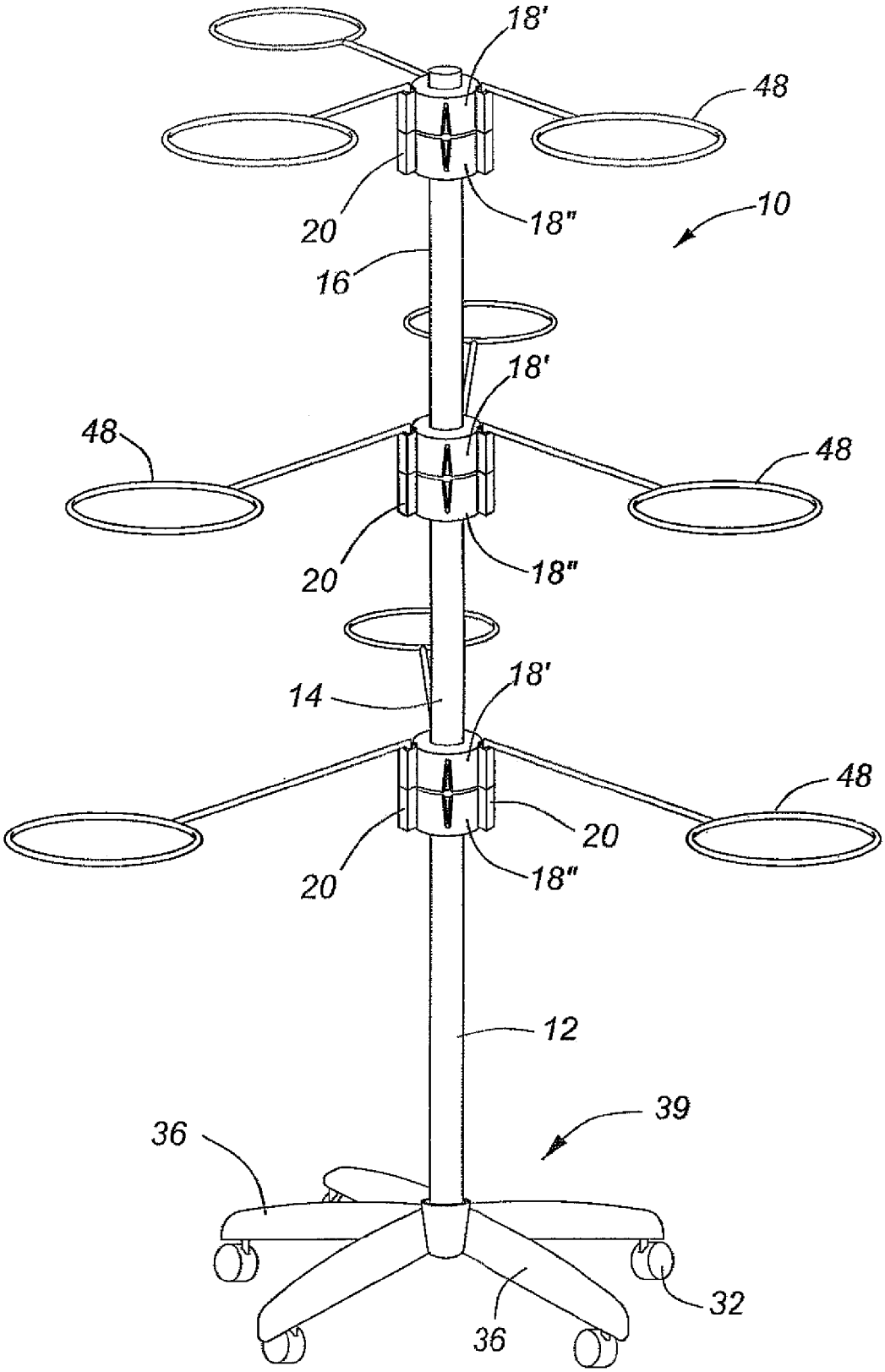
FIG. 1 illustrates a mobile tree-like structure with three tiers, according to the invention.

The invention will be now explained with reference to FIGS. 1 to 6. FIG. 1 illustrates a multi-purpose tree-like structure 10 with three tiers, according to an embodiment of the invention. The tree-like structure 10 is a modular, multi-tier, height adjustable stand, easy to assemble, and is considered advantageous for both practical and aesthetic reasons. More to that, a foldable tree-like configuration can be easily manufactured from commercially available materials and conveniently packed allowing cost saving in shipping and storage.

Tree 10 is comprised of a central stem (pole) assembled from a plurality of stem elements. In the preferred embodiment shown in FIG. 2, there are three connecting elements 12,14,16. More stem elements, or elements with a variety of lengths may be used for adjusting the height of the tree 10 if a larger number of layers is desired, or to position the layers of plants at convenient heights. Elements 12,14,16 are preferably tubular, may be made of plastic or light metals like aluminum, and may have various diameters dependent on the material used and the expected load.

Figure 2:
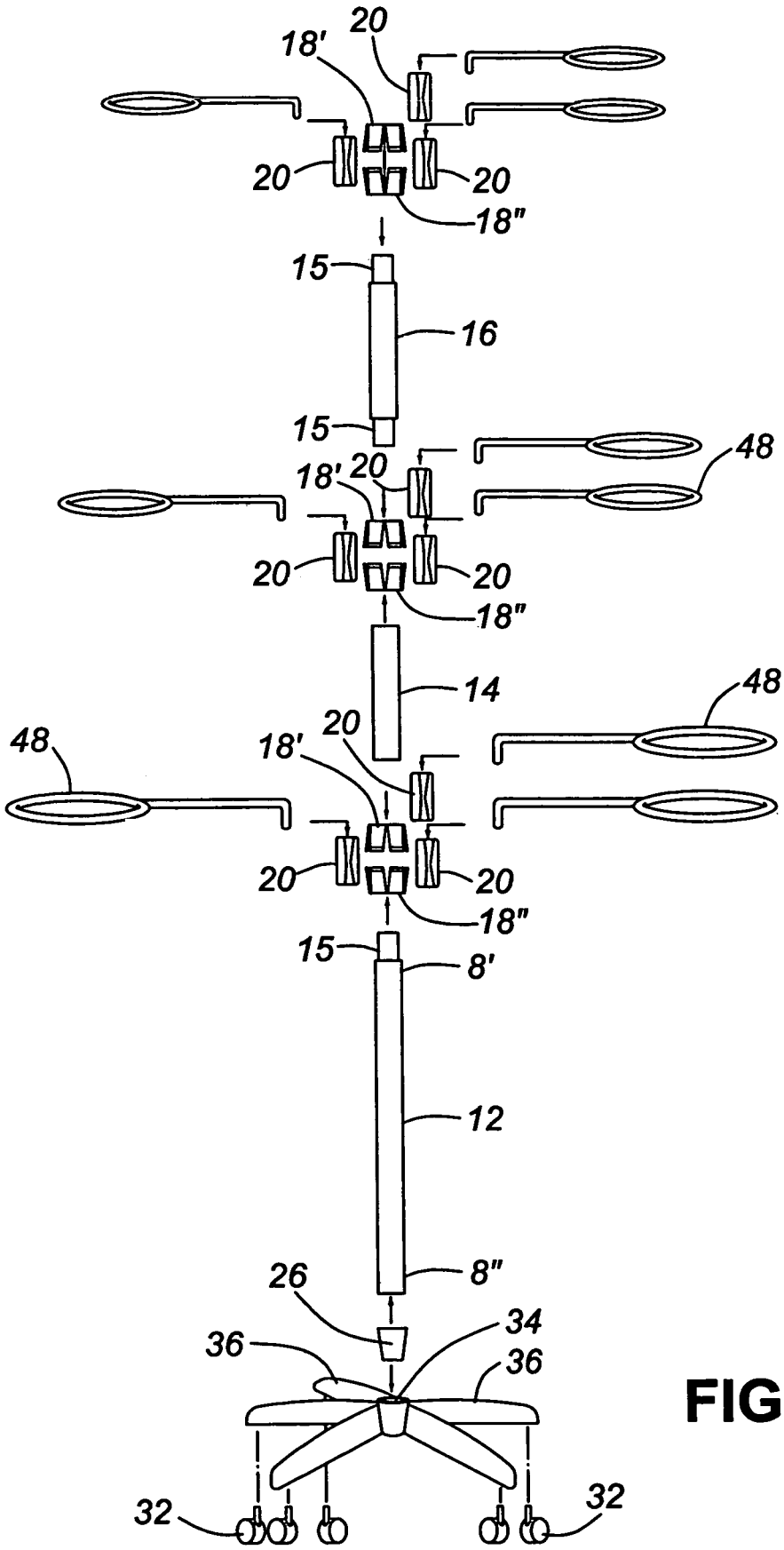
FIG. 2 is an exploded view of the mobile structure of FIG. 1.

The central stem is attached to a base 39, manufactured with a central bore 34 and a plurality of legs 36 radially extending from the central bore 34. Base 39 is preferably made of metal and may be provided with casters 32, as shown in FIG. 2, for enabling easy repositioning the tree as well known. Alternatively, legs 36 may be provided with levelling screws instead of casters, if a fixed position of the tree is desired. To fix the stem to base 39, element 12 is simply inserted in bore 34. Alternatively, a base connector 26 may be used. In both alternatives, element 12 may rotate relative to base 39, but a central stem fixedly mounted in base 39 is preferred.

FIG. 2 is an exploded view of the tree 10 of FIG. 1. The stem elements are connected to each other using stem connectors 15. A dual branch support 18', 18", includes two identical branch supports 18' and 18", and is provided at the junction between two stem elements. Each dual branch support 18', 18", holds a plurality of branches 48, which in turn display objects.

The branches 48 of the tree 10 are connected to the central stem using a plurality of branch supports 18', 18", rotatably mounted on stem connectors 15. Each branch supports 18', 18", may receive a plurality of branch connectors 20. Each connector 20 holds one branch of the tree. Branch support 18', 18", may easily rotate about the central stem so that the layered objects may be arranged in a desired position.

Figure 3A:
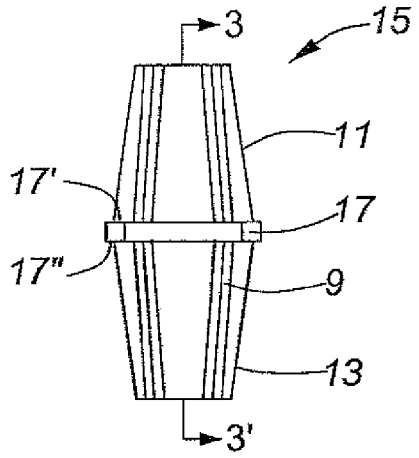
FIG. 3A is a perspective view of a stem connector according to the invention.
Figure 3B:
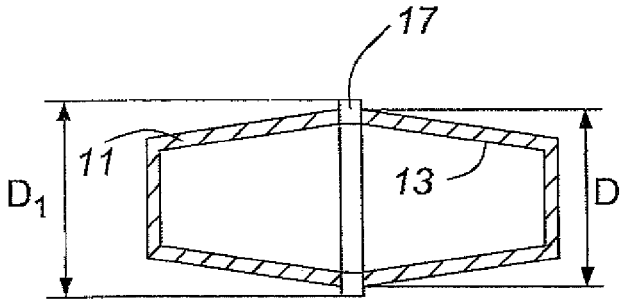
FIG. 3B is a longitudinal section of the stem connector of FIG. 3A along line 3-3'.

FIG. 3A is a perspective view of a stem connector 15, and FIG. 3B is a longitudinal section of the stem connector of FIG. 3A along line 3-3'. A stem connector 15 has two back-to-back slightly tapered plugs 11,13, and a stopping ring 17 provided in between the plugs. The tapered plugs 11,13 have a larger diameter D defined in a region proximate to the stopping ring 17, and may be inserted in the tubular ends 8', 8" of two elements to be connected, so that a snug fit is obtained when fully inserted. The length of the plugs is selected according to the size of the stem elements and diameter D, for axially aligning two stem elements, i.e. 12 with 14,14 with 16, at respective ends 8', 8", while securely keeping the connected elements in a fixed position.

Stopping ring 17 has an external diameter $D_1$ selected such that $D_1$>D, and the difference $D_1$-D is larger than the thickness of the wall of a stem element. As well, the contact surfaces 17',17", of the stopper 17 are smooth, providing minimal friction to rotation when in registry with a similar smooth surface of the dual branch support 18', 18".

Identically shaped longitudinal ribs 9 may be formed on the exterior surface of plugs 11, 13. Ribs 9 may have a triangular cross-section. Preferably, ribs 9 are defined along the entire exterior surface of the tapered plugs 11, 13. The exterior surfaces of ribs 9 are parts of a cylindrical envelope with a diameter slightly smaller than diameter D. In such way, stem connector 15 is provided with flexible insertion plugs inserted at opposite ends of two consecutive stem elements for fixedly connecting two stem elements.

It is to be noted that stem elements 12, 14 and 16 are preferably tubes, with the tubular ends 8', 8" provided at both ends and having an internal diameter D. It is possible to use elements having different cross-sections (triangular, hexagonal, etc), or different sizes for aesthetic reasons. Nonetheless, the ends 8', 8" of the stem elements 12, 14 and 16 and the cross section of the respective plugs 11, 13, need to be identical, while the stopping ring 17 has to be sized for enabling rotation of the branches relative to a fixed central stem, as described later in connection with FIG. 6A.

Figure 4A:
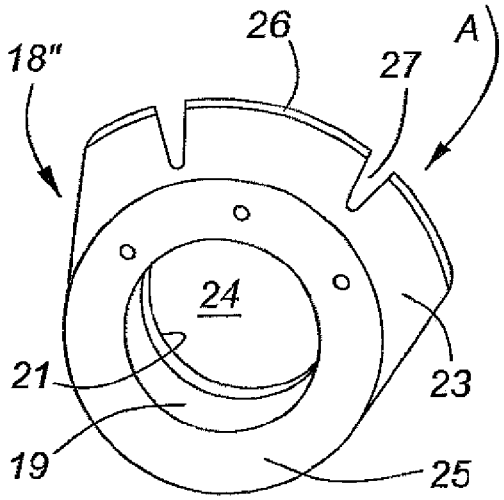
FIG. 4A is a perspective view of a branch support according to the invention.

FIG. 4A is a perspective view of the branch support 18", and F*igure* 4B is a top view of the branch support 18", of FIG. 4A. Support 18' or 18", has a frusto-conical body 23, including an external wall 29, a central tubular hole 24 defined by an internal wall 19 and having a diameter $D_2$, a small base 25, a large base 26, and a plurality of V-shaped slots 27 for receiving the branch arm connectors 20.

As illustrated, the external wall 29 is not continuous. Slots 27 have preferably a V-shaped cross-section, with the tip of the V at a pre-designed distance from the small base 25 for forming pockets 28. A ring 21 with an internal diameter $D_3$ is formed on the internal wall 19, flush with the large base 26.

Figure 4B:
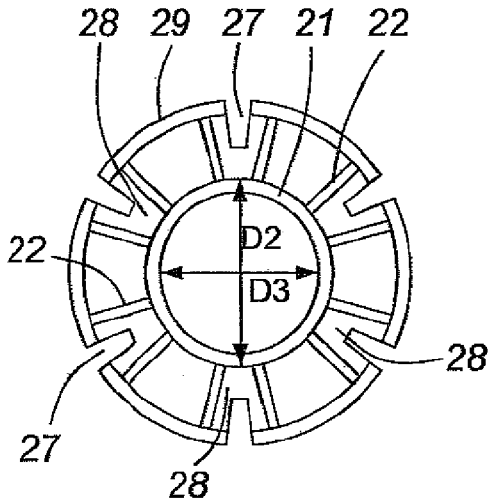
FIG. 4B is a perspective view of the branch support of FIG. 4A from the large base, as shown by arrow A.

The two bases 25, 26, have a general annular shape, and the body between the bases and the walls may be manufactured with a plurality of reinforcing ribs 22, and pockets 28, as seen in FIG. 4B. Each V-shaped slot 27 continues with pocket 28 formed in the body 23, for accommodating a branch connector 20 as described later in connection with FIGS. 6A and 6B. In this way, support 18" is provided with a robust yet flexible structure.

Support 18" is mounted on the stem with the small base 25 directed towards the tree base 39. When branch connectors 20 are inserted into the slots 27, they snap fit securely on the small base 25, which is continuous and has a thickness sufficient to support the weight of the branches 48 and the respective plants. Preferably, there are 6 slots 27 on a dual branch support 18', 18", to enable attachment of 6 branches, but any other number of branches may be considered. Supports 18' and 18" may be placed in symmetry one on top of the other with the large bases 26 in contact and the openings of the V-shaped slots aligned.

Figure 5A:
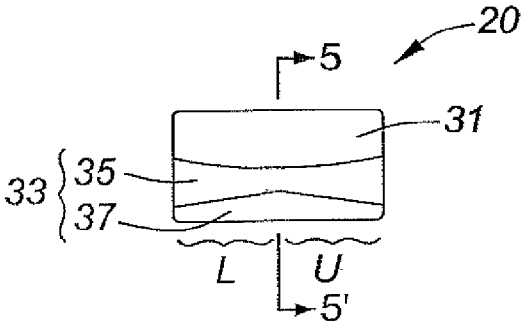
FIG. 5A is a lateral view of a bracket connector.
Figure 5B:
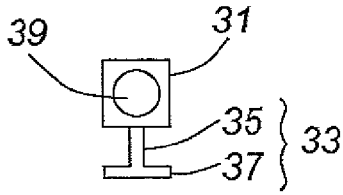
FIG. 5B is a sectional view of the bracket connector of FIG. 6A along line 5-5'.

FIG. 5A is a lateral view of a branch connector 20 and FIG. 5B is a sectional view of the connector of FIG. 5A along line 5-5'. Branch connector 20 has a body 31 and a fin 33. Fin 33 includes a connecting leg 35 and a shoe 37. Shoe 37 tapers from a central region towards the ends of the connector 20 defining two anchor flukes L and U. As seen in FIG. 5B, body 31 has an opening 39, for receiving a branch 48. Body 31 remains exterior to the coupling device 30 and parallel to the longitudinal axis of the central stem, when mounted on the coupling device (30).

Fluke L and fluke U are substantially identical and sized to snap fit into any V-shaped slot 27 and tapered pocket 28. When one of the flukes, let's say fluke L is engaged through V-shaped slot 27 into pocket 28, the branch connector 20 is securely fixed to the support 18", while fluke U of the connector 20 may engage a corresponding, opposite pocket 28 of the second support 18', so that branch connector 20 rotates around the central stem whenever dual branch support 18', 18", rotates.

Figure 6A:
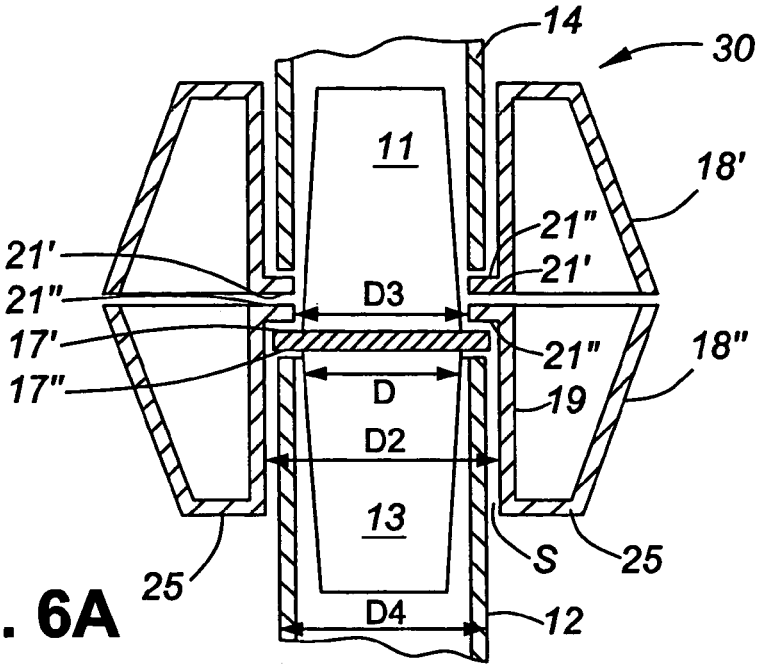
FIG. 6A is a longitudinal sectional view of a coupling device according to the invention.
Figure 6B:
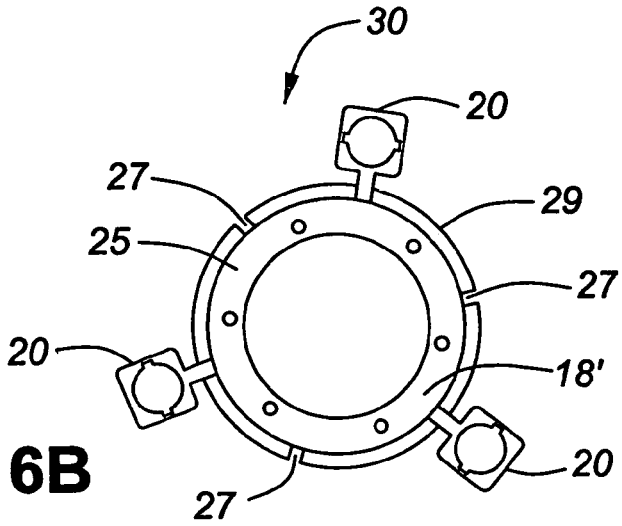
FIG. 6B is a top view of the coupling device of FIG. 6A.

FIG. 6A is a longitudinal sectional view of a coupling device 30 according to the invention. The coupling device 30 includes the dual branch support 18', 18", operatively cooperating with the stem connector 15.

As illustrated, connector 15 connects stem elements 14 and 16 and dual branch support 18', 18", is mounted on contact surface 17' of connector 15. It is now seen that, when fully inserted, stem element 12 engages plug 13 of stem connector 15 on one contact surface 17" of stopper 17, while stem element 14 engages plug 11 of stem connector 15 in contact with surface 17' of stopper 17.

Ring 21 defines two friction surfaces 21', 21" wherein friction surface 21', is defined in a mating plane containing the large base 26. As mentioned before, support 18', is placed on top of support 18", in symmetry relative to the mating plan 26 and in such a way that when ring 21 engages stopper 17, contact surface 17' of stopper 17 comes in registry with friction surface 21" of ring 21. Surfaces 17', 17",21', 22", have a low friction coefficient so that the coupling device 30 may easily rotate with respect to the fixed stem elements, to position the V-shaped slots 27 as desired. In this arrangement, the branch connector 20 snapped fit between two opposite V-shaped slots acts as a safety lock for the entire coupling device 30.

The internal diameter $D_3$ of ring 21 should be slightly larger than the larger diameter D of the plugs 11, 13, the external diameter $D_1$ of the stopper 17 should be slightly smaller than the diameter $D_2$ of hole 24, to allow mounting of the support on stem connector 15. Proper functioning of the coupling device 30 is ensured when $D_2>D_1>D_3>D$, and the thickness of the wall of the stem elements 12 and 14 are selected to fit into the space between the wall 19 of the hole 24 and the respective plug 11, 13.

Dual branch support 18', 18", may be moulded from a suitable plastic material. It is to be noted that internal wall 19 may be moulded separately and then united with the external wall 29 by welding, adhesive or screw threads. It is also to be noted that the body of supports 18' or 18", may be designed differently, with more or less reinforcing ribs 22, more or less V-shaped slots 27, as long as they are sturdy enough to carry a prescribed weight and as long as the diameters discussed above and the surfaces 17' and 21", allow the coupling device 30 to rotate about the central stem.

It is evident that a single support 18" may be enough for forming the coupling device 30 together with branch connectors 20 and one stem connector 15. It is recommendable to use the dual branch connector 18', 18" for aesthetic reasons and robustness.

For assembling the central stem, plug 13 of the stem connector 15 is fully inserted at one end 8' of the stem element 12 until end 8' contacts surface 17" on the stopping ring 17. Branch support 18" is then mounted on plug 11 such that friction surface 21" becomes in registry with contact surface 17'. Branch connectors 20 are mounted on support 18" with lower flukes L snapping fit in V-shaped slots 27. Next, branch support 18' is mounted on plug 11 in symmetry with support 18" relative to their large bases 26. Friction surface 21' of support 18" becomes in registry with friction surface 21' of support 18', while the upper flukes U of the branch connectors 20 snap fit in the V-shaped slots 27 of support 18'. Finally, plug 11 receives stem element 14 and insertion end 8' of the stem element 12 is inserted in bore 34 of the base 39.

When the coupling device 30 is assembled with the stem element 12, plug 11 extends at least 1.5 cm above the small base 25 of support 18'. This allows for easy insertion of the stem element 14 on plug 11. For example, for cylindrical stem elements with a diameter of 4 cm, or 1.5", plugs 11, 13, may have a length of about 5 cm. The coupling device 30 at the upper end of the central stem may be provided with a stem connector 15 having a shorter plug 11 for aesthetic reasons. Alternatively, the upper plug 11 may be cut to size.

When stem element 14 is fully inserted on plug 11, end 8 contacts surface 21" of support 18' of the invention. Stem elements 12, 14, are fixedly attached by stem connector 15 while coupling device 30 can rotate on contact surface 17' without rotating the central stem.

Figure 7A:
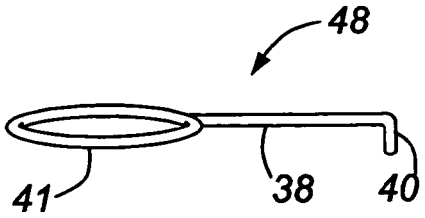
FIG. 7A is a perspective view of a small size bracket.
Figure 7B:
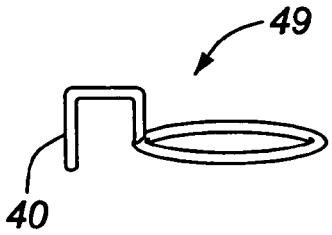
FIG. 7B is a perspective view of a large size bracket.
Figure 7C:
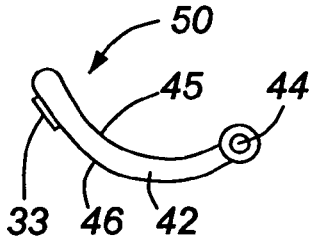
FIG. 7C is a perspective view of a flower basket hook.

FIG. 7A is a perspective view of an embodiment of a tree branch designed with an 8" bracket 48, FIG. 7B is a perspective view of a 4" bracket 49, and FIG. 7C is a perspective view of a flower basket hook 50. Bracket 48 includes a ring 41 and an L-shaped arm with a rod 38 and a peg 40. Peg 40 is inserted into opening 39 of the branch connector 20. Bracket 49 has a shorter rod 38, a slightly different peg 40, and a smaller ring 41, as shown in FIG. 7B. Brackets 48 and 49 may have various lengths and ring diameters for supporting a variety of pots.

The flower basket hook 50 has a slightly different structure and is used for hanging objects, whereby the branch connector 20 is partially used. The flower basket hook 50 has a curved, substantially flat arm 42 with an annular end 44 for hanging objects, and the fin 33 at provided the opposite end. Instead of an annular end 44, a hook may be provided at this end. Flat arm 42 has an inner face 45 relative to the curvature of the hook, and an outer face 46 substantially parallel to the inner face 45. Fin 33 is provided integral with the outer face 46 allowing upward mounting, where annular end 44 is positioned above fin 33. Downward mounting is also possible, in which case annular end 44 is positioned below fin 33.

It is understood that once mounted on branch support 18', 18", hook 50 becomes part of the multi-purpose coupling device 30 and rotates whenever support 18', 18" rotates, without rotating the central stem.

Branches 48 are used as for supporting objects to be displayed. When pegs 40 are mounted in holes 39, brackets 48, 49, 50 may independently rotate in a horizontal plane relative to branch connector 20. If more branches are mounted on the same branch support 18, a tier of potted flowers may be formed in a horizontal plane. It is understood that rings 41 may be replaced with any suitable supporting means, like for example disk-shaped bases for displaying objects. Flower basket hooks 50 may be mounted on the same layer, or tier with brackets 48, 49, but for aesthetic reasons and balance it is advisable to have hooks 50 separately mounted in one tier.

A modular, mobile tree-like structure 10 for holding or hanging potted plants has been presented. The tree-like structure 10 occupies a minimal area of the floor,. and is suitable as an indoor flower/herbs stand. Pots may be supported by various length/size brackets, which are movable in horizontal planes in various directions until an un-obstructing tree configuration is reached which also allows easy access to plants. The use of various length/size brackets in a multi-tier arrangement which can rotate independent from the central stem, allows for an increased number of potted plants to be adequately displayed on a given floor surface in the preferred space relationship.

A number of stem elements may be connected to form the height adjustable central stem of the invention. Modular tree 10 is a do-it-yourself article easy to assemble and use. The layers of plants may be formed at predetermined heights by cutting the stem elements to the desired length. Preferably, stem element 12 is a 60 cm (24") long cylinder, and stem elements 14, 16, are 30 cm (12") long cylinders with the same 4 cm (1.5") diameter forming a tree with three layers. Six V-slots may be provided on each coupling device 30 for displaying a total of 18 potted plants.

When disassembled, tree 10 may be easily stored/shipped in a 50 cm×50 cm×15 cm box as it weights less than 5 Kg.

Numerous modifications, variations, and adaptations may be made to the particular embodiments of the invention without departing from the scope of the invention as defined in the claims.

I claim:

1. In a display tree-like structure of the type having a stem made of a plurality of end-to-end connected stem elements and a plurality of branches for holding objects, a multi-purpose coupling device for connecting two consecutive stem elements, comprising:

a stem connector having a lower plug and an upper plug joined by a stopping ring, said stopping ring extending at the exterior of said stem connector between said plugs;

a first branch support comprising a smaller base and a larger base connected by an inner and an outer wall, said outer wall defining a frusto-conical body, said inner wall forming an axially aligned cylindrical bore, said first branch support further comprising a friction ring extending radially inwardly within said axially aligned cylindrical bore and comprising a first and a second friction surface, wherein said first friction surface is defined in a mating plane containing said larger base and is configured to engage said stopping ring of said stem connector while allowing rotation of said first branch support about said stem connector, a plurality of branch arm connectors; and a plurality of V-shaped slots and associated pockets formed in said frusto-conical body for receiving the branch arm connectors supporting said plurality of branches.

2. The coupling device as claimed in claim 1, further comprising a stem element having an internal diameter configured to receive at least a portion of said stem connector, wherein each plug has a tapered outer wall and an annular cross-section increasing towards said stopping ring until an external diameter D is provided proximate to said stopping ring, , the diameter D being substantially equal to the internal diameter of said stem element wherein at least a portion of said stopping ring is configured to engage with said stem element when said stem connector is received in said stem element.

3. The coupling device as claimed in claim 2, wherein each plug comprises a plurality of longitudinally extending ribs.

4. The coupling device as claimed in claim 1, wherein said axially aligned cylindrical bore has a diameter $D_2$, and is sized to slide over said upper plug until a friction surface of said friction ring becomes in registry with a contact surface of said stopping ring.

5. The coupling device as claimed in claim 4, wherein said friction ring is formed adjacent to said large base and has a diameter $D_3$ less than $D_2$ and $D_3$ greater than D, and wherein a diameter $D_1$ of said stopping ring is smaller than said diameter $D_2$ for enabling rotation of said branch support around said stem.

6. The coupling device as claimed in claim 4, further comprising a second branch support mounted on top of and in symmetry with said first branch support.

7. The coupling device as claimed in claim 6, wherein respective V-shaped slots on said first and second branch supports receive one branch arm connector in associated opposite pockets, whereby said branch connector provides a safety lock for said coupling device.

8. The coupling device as claimed in claim 1 wherein said plurality of V-shaped slots provide access to the associated pocket for each branch arm connector.

9. The coupling device as claimed in claim 8, wherein the tips of the plurality of V-shaped slots are directed towards the associated pocket.

10. The coupling device as claimed in claim 9, wherein each of said plurality of branch arm connectors have a body and a shoe, said shoe integrally formed with said body and sized to snap fit into said associated pocket.

11. In a display tree-like structure of the type having a stem made of a plurality of end-to-end connected stem elements and a plurality of branches for holding objects, a multi-purpose coupling device for connecting two consecutive stem elements, comprising:

a stem connector having a lower plug and an upper plug joined by a stopping ring, said stopping ring extending at the exterior of said stem connector between said plugs;

a first branch support comprising a smaller base and a larger base connected by an inner and an outer wall, said outer wall defining a frusto-conical body, said inner wall forming an axially aligned cylindrical bore defined by an inner wall, a friction ring extending radially inwardly within said axially aligned cylindrical bore configured to engage said stopping ring of said stem connector while allowing rotation of said first branch support about said stem connector, a plurality of branch arm connectors;

a plurality of V-shaped slots and associated pockets formed in said frusto-conical body for receiving the branch arm connectors supporting said plurality of branches; and a stem element having an internal diameter configured to receive at least a portion of said stem connector, wherein each plug has a tapered outer wall and an annular cross-section increasing towards said stopping ring until an external diameter D is provided proximate to said stopping ring, the diameter D being substantially equal to the internal diameter of said stem element such that at least a portion of said stopping ring is configured to engage with said stem element when said stem connector is received in said stem element, wherein said axially aligned cylindrical bore has a diameter $D_2$, and is sized to slide over said upper plug until a friction surface of said friction ring becomes in registry with a contact surface of said stopping ring.

12. The coupling device as claimed in claim 11, wherein each plug comprises a plurality of longitudinally extending ribs.

13. The coupling device as claimed in claim 11, wherein said friction ring is formed adjacent to said large base and has a diameter $D_3$ less than $D_2$ and $D_3$ greater than D, and wherein a diameter $D_1$ of said stopping ring is smaller than said diameter $D_2$ for enabling rotation of said branch support around said stem.

14. The coupling device as claimed in claim 11 wherein said plurality of V-shaped slots provide access to the associated pocket for each branch arm connector.

15. The coupling device as claimed in claim 14, wherein the tips of the plurality of V-shaped slots are directed towards the associated pocket.

16. The coupling device as claimed in claim 15, wherein each of said plurality of branch arm connectors have a body and a shoe, said shoe integrally formed with said body and sized to snap fit into said associated pocket.

17. The coupling device as claimed in claim 11, further comprising a second branch support mounted on top of and in symmetry with said first branch support.

18. The coupling device as claimed in claim 17, wherein respective V-shaped slots on said first and second branch supports receive one branch arm connector in associated opposite pockets, whereby said branch connector provides a safety lock for said coupling device.

19. In a display tree-like structure of the type having a stem made of a plurality of end-to-end connected stem elements and a plurality of branches for holding objects, a multi-purpose coupling device for connecting two consecutive stem elements, comprising:

a stem connector having a lower plug and an upper plug joined by a stopping ring, said stopping ring extending at the exterior of said stem connector between said plugs;

a first branch support comprising a smaller base and a larger base connected by an inner and an outer wall, said outer wall defining a frusto-conical body, said inner wall forming an axially aligned cylindrical bore defined by an inner wall, a friction ring extending radially inwardly within said axially aligned cylindrical bore, wherein said axially aligned cylindrical bore has a diameter $D_2$ sized to slide over said upper plug until a friction surface of said friction ring becomes in registry with a contact surface of said stopping ring while allowing rotation of said first branch support about said stem connector, a second branch support mounted on top of and in symmetry with said first branch support;

a plurality of branch arm connectors; and a plurality of V-shaped slots and associated pockets formed in said frusto-conical body for receiving the branch arm connectors supporting said plurality of branches, wherein said friction ring is formed adjacent to said large base and has a diameter $D_3$ less than $D_2$ and $D_3$ greater than D, and wherein a diameter $D_1$ of said stopping ring is smaller than said diameter $D_2$ for enabling rotation of said branch support around said stem.

20. The coupling device as claimed in claim 19, further comprising a stem element having internal diameter configured to receive at least a portion of said stem connector, wherein each plug has a tapered outer wall and an annular cross-section increasing towards said stopping ring until an external diameter D is provided proximate to said stopping ring, the diameter D being substantially equal to the internal diameter of said stem element such that at least a portion of said stopping ring is configured to engage with said stem

21. The coupling device as claimed in claim 20, wherein each plug comprises a plurality of longitudinally extending ribs.

22. The coupling device as claimed in claim 19 wherein said plurality of V-shaped slots provide access to the associated pocket for each branch arm connector.

23. The coupling device as claimed in claim 22, wherein the tips of the plurality of V-shaped slots are directed towards the associated pocket.

24. The coupling device as claimed in claim 23, wherein each of said plurality of branch arm connectors have a body and a shoe, said shoe integrally formed with said body and sized to snap fit into said associated pocket.

25. The coupling device as claimed in claim 19, wherein respective V-shaped slots on said first and second branch supports receive one branch arm connector in associated opposite pockets, whereby said branch connector provides a safety lock for said coupling device.

* * * * *